United States Patent [19]

Bärtschi et al.

[11] Patent Number: 4,842,213

[45] Date of Patent: Jun. 27, 1989

[54] CATCHING RIBBON HAVING THREAD-ENGAGING ELEMENTS FOR CATCHING AND HOLDING A THREAD ON A THREAD SUPPORT AND SLIP-ON RING PROVIDED WITH SUCH CATCHING RIBBON

[75] Inventors: Peter Bärtschi, Kriens; Peter Fust, Winterthur, both of Switzerland

[73] Assignees: Viscosuisse SA, Emmenbrücke; Maschinenfabrik Rieter AG, Winterthur, both of Switzerland

[21] Appl. No.: 191,340

[22] Filed: May 9, 1988

Related U.S. Application Data

[63] Continuation-in-part of Ser. No. 882,302, Jul. 7, 1986, abandoned.

[30] Foreign Application Priority Data

Jul. 12, 1985 [CH] Switzerland ..... 03043/85

[51] Int. Cl.[4] ..... B65H 75/28

[52] U.S. Cl. ..... 242/125.1

[58] Field of Search ..... 242/125.1, 18 PW; 2/DIG. 6

[56] References Cited

U.S. PATENT DOCUMENTS

| | | | |
|---|---|---|---|
| 3,138,841 | 6/1964 | Naimer | 2/DIG. 6 X |
| 3,967,795 | 7/1976 | Shindo et al. | 242/125.1 |
| 3,986,680 | 10/1976 | Cardell | 242/125.1 |
| 4,184,652 | 1/1980 | Rovin | 242/125.1 X |

FOREIGN PATENT DOCUMENTS

| | | | |
|---|---|---|---|
| 2647544 | 4/1978 | Fed. Rep. of Germany . | |
| 2217252 | 9/1974 | France . | |
| 2463088 | 2/1981 | France . | |
| 639349 | 11/1983 | Switzerland . | |
| 1341034 | 12/1973 | United Kingdom | 242/125.1 |
| 2104873 | 3/1983 | United Kingdom . | |

*Primary Examiner*—Stanley N. Gilreath
*Attorney, Agent, or Firm*—Werner W. Kleeman

[57] ABSTRACT

A catching ribbon for catching and holding a thread on a thread support, such as a thread wind-up bobbin rotating at high speed, is provided at its circumference with catching elements. These catching elements comprise thread engaging portions, such as hooks. The space between two thread engaging portions of two immediately adjacent catching elements are positioned to allow a single thread passage therebetween but precluding thread retro-movement. The catching elements comprise miniature pins provided with heads configured to form the thread engaging portions, such as semi-circular heads or anchor-like heads similar to kedge anchors. Catching elements with a single thread engaging portion, such as a single hook, also may be provided. Successive rows of the single-hook catching elements or successive rows of the double-hook catching elements may be arranged in staggered relationship. The projection of one row of such catching elements into the immediately adjacent row of staggered catching elements results in the formation of a continuous thread catching surface. The catching ribbon serves for reliably catching textile threads or filaments of all kinds during take-up at initiation of thread winding. The catching ribbon also permits easy cleaning and thus repeated use of a slip-on ring provided with the catching ribbon for use on the thread wind-up bobbin.

21 Claims, 3 Drawing Sheets

Fig. 7
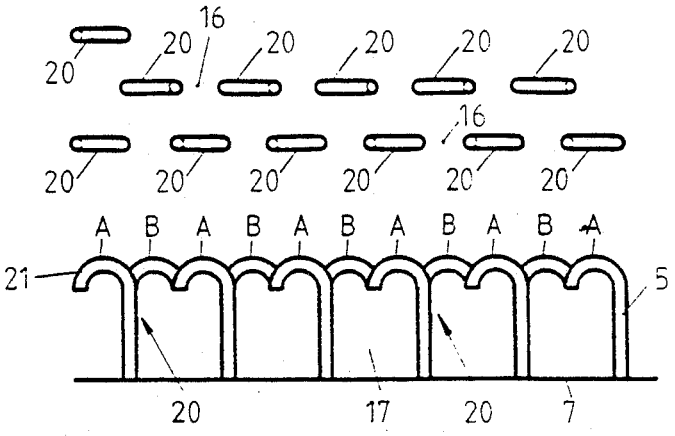
Fig. 8
Fig. 9
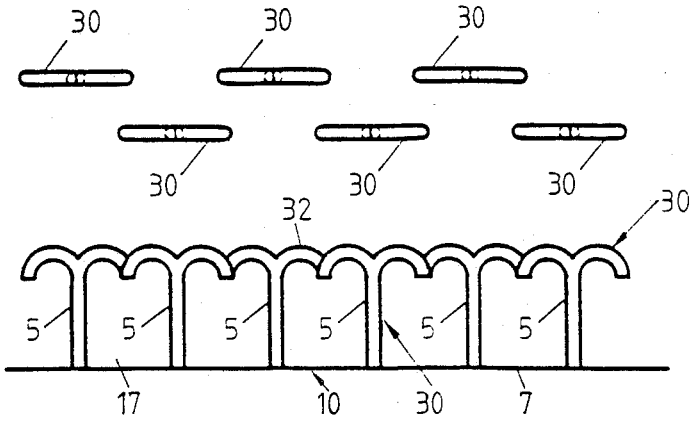
Fig.10

CATCHING RIBBON HAVING THREAD-ENGAGING ELEMENTS FOR CATCHING AND HOLDING A THREAD ON A THREAD SUPPORT AND SLIP-ON RING PROVIDED WITH SUCH CATCHING RIBBON

CROSS-REFERENCE TO RELATED APPLICATION

This application is a continuation-in-part application of the commonly assigned, copending U.S. patent application Ser. No. 06/882,302, filed July 7, 1986, and entitled "CATCHING RIBBON HAVING HOOK-LIKE ELEMENTS FOR CATCHING AND HOLDING A THREAD ON A THREAD SUPPORT AND SLIP-ON RING PROVIDED WITH SUCH CATCHING RIBBON", now abandoned.

BACKGROUND OF THE INVENTION

The present invention relates to a new and improved construction of a thread catching ribbon or tape for uses with thread support means, such as bobbins or the like, especially a thread support or thread support means rotating at high speed. The present invention also relates to a slip-on or attachment ring for the thread support means, and specifically to a slip-on or attachment ring provided with such catching ribbon or tape which is of the type having thread engaging catching elements for catching and holding a thread on the thread support means. The present invention further relates to a thread support or thread support means provided with such slip-on or attachment ring.

Swiss Patent No. 639,349, granted Nov. 15, 1983 discloses a slip-on ring of the type which is inserted into a thread support rotating at high speed in order to catch and hold the start of a thread. With this device the moving thread is caught in a curved recess between the slip-on ring and a face of the thread support. The disadvantage of this construction is that the thread has to be applied quite exactly to the curved recess. In the event there occurs a small deviation from the curved recess which is relatively narrow, then when applying the thread, catching and holding of such thread becomes impossible.

French Published Patent Application No. 2,217,252, published June 9, 1974 which corresponds to U.S. Pat. No. 3,967,795, granted July 6, 1976, teaches a catching ribbon or tape comprising a plastic tape having hook-like protrusions at its surface acting as catching elements for a thread. This catching ribbon or tape, however, has the disadvantage that the thread to be caught may slip through the catching elements, since, although closely arranged, they are unidirectionally oriented and too far apart in comparison to the thickness of a thread. A further disadvantage arises when cleaning the ribbon or tape of thread remnants before the bobbin is reused. A thread once caught is well-retained but its relatively long thread remnant or remainder is removable only with difficulty.

SUMMARY OF THE INVENTION

With the foregoing in mind, it is a primary object of the present invention to a provide a new and improved catching ribbon or tape permitting a reliable and simple catching and holding of the starting end of a thread or filament or the like when being drawn in on a thread support, such as a bobbin.

A further and more specific object of the present invention is to provide a new and improved catching ribbon or tape allowing unproblematic cleaning of thread remnants or remainders for achieving reliable repetitive use of the catching ribbon or tape.

Yet a further important object of the present invention is to provide a new and improved catching ribbon or tape of reduced width.

Another significant object of the present invention is to provide a new and improved catching ribbon or tape having a limited number of thread catching elements, yet still having optimal density and sufficient open space between the thread catching elements so as to facilitate subsequent cleaning of thread remnants.

A further important object of the present invention is to provide a new and improved catching ribbon or tape suitable for all known textile threads or the like.

Another noteworthy object of the present invention is to provide a new and improved thread catching ribbon or tape which allows for an economical manufacture of a slip-on ring for a thread support or carrier and equipped with such thread catching ribbon or tape.

An additional significant object of the present invention is to provide a thread support structure containing a slip-on ring equipped with a thread catching ribbon or tape constructed according to the invention for the reliable catching of a thread or filament or the like.

Now in order to implement these and still further objects of the invention, which will become more readily apparent as the description proceeds, the catching ribbon or tape of the present invention is manifested, among other things, by the features that the catching ribbon forms at least part of an attachment or slip-on ring for a thread support or carrier. The catching ribbon can be provided with adjacently arranged thread catching elements. Each of the thread catching elements has a head or head portion. Each such head may be structured to have two thread engaging portions, so as to define a double thread-engaging head or head portion. Each such double thread-engaging head may comprise a double-hook head.

Advantageously, the thread catching elements may be arranged such that the double thread-engaging heads, such as the double-hook heads, almost touch each other, so that the thread may easily enter open spaces formed between the double thread-engaging heads but cannot again escape therefrom.

The thread catching elements also may be constituted by single-hook heads so that there is defined a single thread-engaging head. It is possible to arrange the thread catching elements in rows, whether such be of the type having double thread-engaging heads or single thread-engaging heads. The thread catching elements of each row are arranged in neighboring relationship. Moreover, the thread catching elements of any one row are arranged in offset fashion or staggered relationship with respect to the thread catching elements of each immediately adjacent row. Hence, the projection of the thread catching elements of any one row into the immediately adjacent row forms a continuous or closed thread catching surface. Because of the staggered relationship or disposition of the thread catching elements of any one row with respect to the thread catching elements of the immediately adjacent row the thread extends in a serpentine or undulated path between each two successive rows, thus promoting the retention of the caught thread at the thread catching elements.

In a preferred embodiment of the invention the catching ribbon or tape is a plastic ribbon, whose surface is composed of pin-like protrusions or pins or stems having small thread engaging heads of various geometrical form, as described above for instance, located at the free ends of these pin-like protrusions or pins. The thread engaging heads are formed such and the arrangement of the thread catching elements is accomplished such that a thread will remain positively stuck or caught and held on the attachment or slip-on ring even while the thread support or carrier is rotating at high speed. It is particularly advantageous when the thread engaging heads almost touch one another and leave open therebetween an intermediate space or opening through which the thread or filament or the like—herein generally simply termed thread—can readily pass. Thus, an optimal density of the pins or stems supporting the thread engaging heads is obtained while limiting their total number and still allowing sufficient free space between these supporting pins or stems so that subsequent cleaning of thread remnants or remainders can be easily and effectively carried out.

According to one specific embodiment, the thread engaging head of each thread catching element is of substantially semi-circular shape. In the context of this disclosure, the term "semi-circular shape" or equivalent is not to be construed in a limiting sense and as strictly meaning an absolutely semi-circular shape, but such terminology is utilized o denote a thread catching element whose head deviates from such shape and even has a substantially semi-spherical shape. The outer side or surface of the thread engaging head of the thread catching element can be convex or arched in shape as viewed by an observer from the head end towards the pin of each such thread catching element.

A particularly advantageous construction is realized if the heads are substantially anchor-shaped to form double hooks. In this case the ends of the head of each thread catching element, and which ends are bent and converge or taper toward the associated pin or stem, function in the manner of counter-barbs which outstandingly augment the thread catching properties of the thread catching elements, here in the form of double-hook heads.

The pins or stems together with their terminal thread engaging heads or portions preferably are formed of a suitable plastic material. However, they can be formed of any other suitable material.

It is advantageous to imbed the catching ribbon or tape and specifically the thread catching elements at their base region between plastic material in such a manner that the outer surface of each of the thread engaging heads forms in conjunction with the circumference of the slip-on or attachment ring approximately a surface or, stated in another way, substantially lie in a plane. It is advantageous to mount a cover ring at the side of the slip-on ring which faces away from the free or outer edge or face of the slip-on ring. In lieu of the cover ring it is, however, possible for a protrusion or raised portion which is initially provided at the slip-on ring to form with the outer edge or face a recess for the catching ribbon or tape.

It is also possible to design the thread catching ribbon or tape such that during its fabrication the thread catching elements are structured as integrated parts or components of the thread catching ribbon or tape.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 7 is a schematic top plan view showing a different construction and arrangement of the thread catching elements comprising single thread-engaging heads of a modified construction of catching ribbon or tape;

FIG. 8 is a front elevational view of the arrangement of thread catching elements of the modified construction of catching ribbon or tape depicted in FIG. 7;

FIG. 9 is a top plan view of a further construction of thread catching elements containing double-hook heads of a further modified form of catching ribbon or tape; and FIG. 10 is a schematic front elevational view of the modified arrangement of catching ribbon or tape depicted in FIG. 9.

DETAILED DESCRIPTION OF THE PREFERRED EMBODIMENTS

Figure 1:
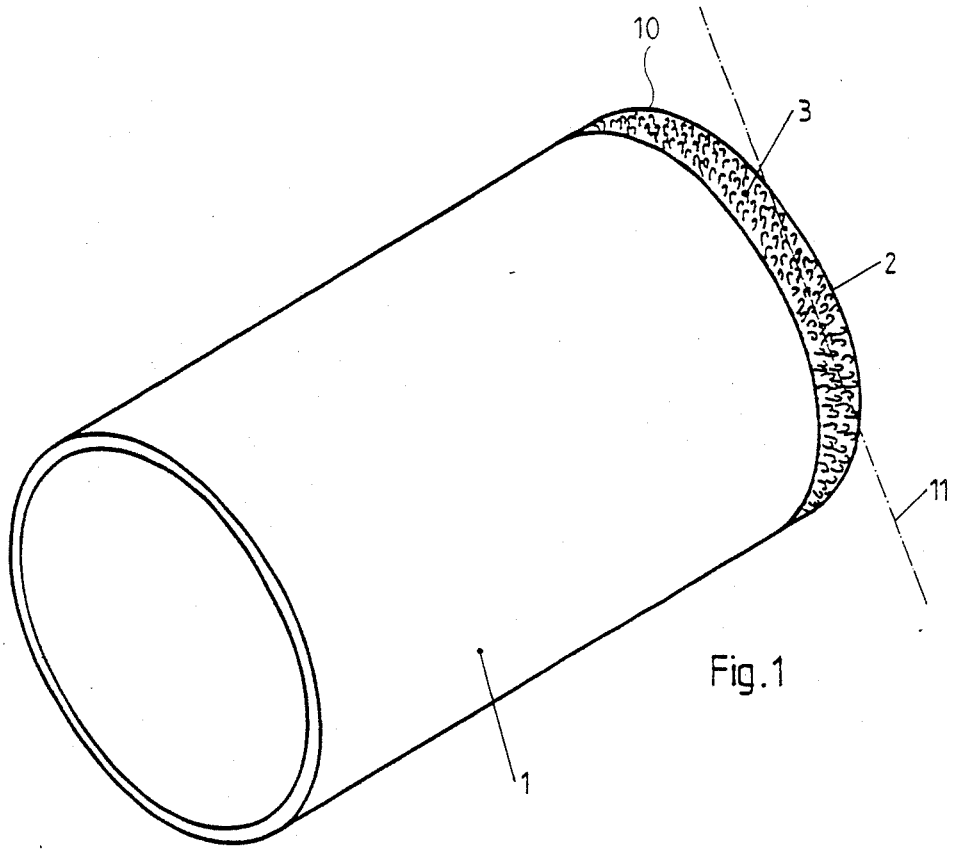
FIG. 1 is a perspective view of a thread support or carrier provided with an attachment or slip-on ring according to the present invention.
Figure 3:
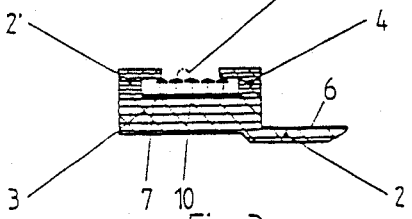
FIG. 3 is a cross-sectional view of the attachment or slip-on ring provided with a catching ribbon or tape, taken substantially along the line A—A in FIG. 2.

Describing now the drawings, it is to be understood that to simplify the showing thereof only enough of the structure of the herein disclosed various exemplary embodiments of catching ribbon or tape for catching and reliably holding a thread or the like on a thread support or thread support means, such as a bobbin or the like has been illustrated therein as is needed to enable one skilled in the art to readily understand the underlying principles and concepts of the invention. Turning now specifically to FIG. 1 of the drawings, a thread support or a thread support means 1 formed of a suitable material such as paper board or plastic is provided with a slip-on or attachment ring 2 conventionally held in place by friction. At the circumference of the slip-on ring 2 there is provided a catching ribbon or tape 10 having elastic thread catching elements, generally indicated by reference character 3 in FIG. 1. These elastic thread catching elements 3 may be specifically constructed in the manner discussed hereinafter more fully with reference, for instance, to the thread catching element 3*a* of FIG. 4, or the thread catching element 3' of FIG. 5, or the thread catching elements 20 of FIGS. 7 and 8 or the thread catching elements 30 of FIGS. 9 and 10. The inner edge of the slip-on ring or ring member 2 may carry a cover ring or ring means 4 as may also the oppositely situated outer edge or periphery, as shown, for instance, in FIG. 3. As generally indicated in FIG. 3, the supporting region or surface 7 of the catching ribbon 10 is provided with pins or pin-like protrusions or stems 5 which exert, by means of the associated thread engaging heads or head portions of the catching elements 3, a thread gripping action, as will be more fully explained hereinafter. The thread catching elements 3 may be arranged in a random or ordered array or arrangement at the catching ribbon 10.

Figure 2:
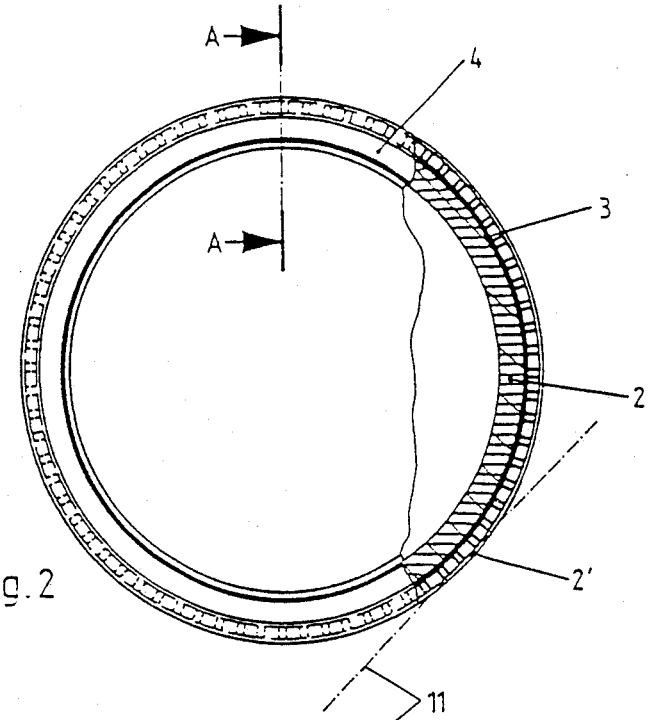
FIG. 2 is a front view, partially in section, of the attachment or slip-on ring shown in FIG. 1.

FIG. 2 shows a section of the attachment or slip-on ring 2 in the region of the catching ribbon 10, as viewed from the bobbin interior. The catching ribbon 10 is attached between the periphery or end face 2' of the slip-on ring 2 or the cover ring 4 if one is provided at that location and the other cover ring 4 located at the inside of the slip-on ring 2.

FIG. 3 shows a cross-section of the thread catching elements 3 arranged adjacent a seating region or seat 6 of the slip-on ring 2. The thread catching elements 3 are disposed on a supporting region or surface 7 of the catching ribbon 10 between the cover rings or ring means 4.

Figure 4:
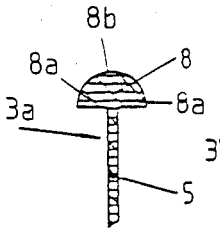
FIG. 4 illustrates a pin or stem having a double thread-engaging head of a thread catching element and located on the surface of the catching ribbon or tape shown in FIG. 3.

FIG. 4 shows one embodiment of a thread catching element 3 comprising a pin or pin-like protrusion or stem 5 having a cap or head 8 of substantially semi-circular shape and defining one construction of thread catching element 3*a* having a double thread-engaging head or head portion 8. Each such arched or curved double thread-engaging head 8 has a thread engaging region or portion 8*a* at opposite sides of the upright pin-like protrusion or stem 5. Consequently, a thread or filament 11 or the like coming in contact with the cap or head 8 will slide along the curved outer surface 8*b* towards the one or the other side of the upright pin-like protrusion or stem 5 and enter the space 16 (FIG. 6) between two such neighboring thread catching elements 3*a* as will be explained more fully hereinafter with reference to FIG. 6. The thread 11 will thus be reliably retained in the space 17 (FIG. 6) between the two neighboring thread catching elements 3*a* and held therein by the thread engaging regions or portions 8*a*.

Figure 5:
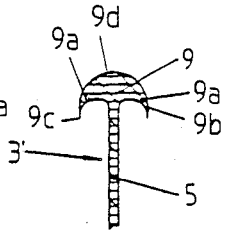
FIG. 5 illustrates a further embodiment of a thread catching element having a double thread-engaging head at a pin of the thread catching element and constructed to form a double-hook head.

According to the modified construction of thread catching element 3' shown in FIG. 5, the double thread-engaging head 9 of the pin or stem 5 is formed to possess an anchor shape, in other words, has an anchor-like head similar to a kedge anchor. Here also the double thread-engaging head 9 has the thread engaging regions or portions 9*a* located to opposite sides of the upright pin or stem 5. Moreover, the rim 9*b* of the double thread-engaging head 9 is bent towards the associated pin or stem 5, forming a barb 9*c* to each side of the pin or stem 5 and which converges or tapers to a point or tip in the direction of such pin or stem 5. In this way there is thus considerably enhanced the thread catching action. There is thus formed what may be termed a double-hook thread catching element 3'.

Figure 6:
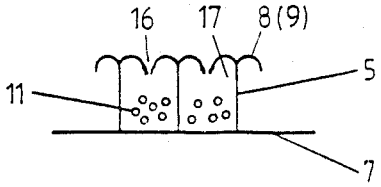
FIG. 6 is a schematic representation of a group of adjacently arranged thread catching elements containing double thread-engaging heads and which may be of the type depicted in either FIGS. 4 or 5.

FIG. 6 schematically shows three thread catching elements, such as the aforedescribed thread catching elements 3*a* (FIG. 4) or 3' (FIG. 5), having thread remnants 11 lodged between the associated pins or stems 5. It will be observed that each two neighboring thread catching elements 3*a* or 3', as the case may be, are arranged in adjacent relationship and nearly touching one another at the double thread-engaging heads 8 or 9, as the case may be. The spacing between each two neighboring double thread-engaging heads 8 or 9 of the thread catching elements 3*a* or 3', as the case may be, is such that a single thread or filament 11 can pass between the opening 16 located intermediate each two neighboring double thread-engaging heads 8*a* or 9*a* of adjacent thread catching elements 3*a* or 3', as the case may be. This opening or passage 16 is of substantially funnel-shaped configuration by virtue of the downwardly directed orientation of the thread engaging regions or portions 8*a* or 9*a* of the related double thread-engaging heads 8 or 9, respectively, so that the thread or filament 11 is reliably caught and permitted to pass through such funnel-shaped opening 16 into the space 17 located below each two neighboring thread catching elements 3*a* or 3', as the case may be. Hence, a thread or filament 11 which has been deposited into such space 17 cannot readily undertake any retro or return movement upwardly out of such space 17. The respective thread catching elements 3*a* and 3 advantageously each constitute elastic thread catching elements which thus facilitates the thread catching action and passage of the thread or filament 11 along the curved outer surface 8*b* or 9*d* of the related double thread-engaging head 8 or 9 of the corresponding thread catching element 3*a* or 3', respectively, and deposition of such entrained thread or filament 11 into the space 17 located therebelow. The mutual spacing of each two neighboring adjacently arranged thread catching elements 3*a* or 3' is such that the formed space 17 allows the deposition therein of a large number of thread or filament coils. This spacing between the pins or stems 5 of each two neighboring thread catching elements 3*a* or 3' may be in the order of approximately one to four millimeters. There is thus also facilitated the cleaning of thread remnants or remainders from such spaces 17.

A further embodiment of thread catching element 20 arranged on the supporting region or support surface 7 of the catching ribbon 10 has been depicted in FIGS. 7 and 8. Here the elastic thread catching elements 20 have a substantially semi-circular or hook-like head portion 21 located at one side of the pin-like protrusion or stem 5. As will be seen from the showing of FIG. 7 the mutually spaced thread catching elements 20 are arranged in successive or tandem rows with the single hook-like thread engaging heads 21 of any given row all extending in the same direction or to the same side of the associated pin-like protrusion or stem 5. It also will be observed that for the next following or immediately adjacent row the spaced elastic thread catching elements 20 have the hook-like thread engaging heads 21 directed to the opposite side of the pin-like protrusions or stems 5 in relation to the direction of extent of the hook-like thread engaging portions 21 of the thread engaging elements 20 of the adjacent row.

As particularly evident by inspecting FIG. 7, the thread catching elements 20 of any one row are offset or staggered with respect to the position of the thread catching elements 20 of the immediately adjacent row. Even so, a thread or the like can be reliably caught by the hook-like thread engaging heads 21 inasmuch as the projection of such hook-like thread engaging heads 21 of any one row of thread catching elements 20 into the immediately adjacent row of thread catching elements, particularly by virtue of the staggered or offset arrangement described above, results in a continuous or closed thread catching surface of such hook-like thread engaging heads 21. Such entrained thread or filament or the like passes in an undulated or curved path of travel between the openings 16 of adjacent rows. Due to the described staggered arrangement of the thread catching elements 20 between neighboring rows there is provided a larger dimension or size of the spaces 17, thus facilitating cleaning thereof of thread remnants or remainders.

A modification of the arrangement of FIGS. 7 and 8 is depicted in FIGS. 9 and 10, wherein here the elastic thread catching element 30, similar to the arrangement of FIGS. 4 and 5, have double thread-engaging heads 31. These double thread-engaging heads 31 may be formed of double-hook members 32 similar to the arrangement of FIG. 5 previously disclosed. Here also, and like the arrangement of the single-hook thread catching elements 20 of FIGS. 7 and 8, the double-hook thread catching elements 30 of the modification of FIGS. 9 and 10 are also arranged in rows, wherein the thread catching elements 30 of any one row are staggered or offset with respect to the thread catching elements 30 of the immediately neighboring row. Similarly, the projection of the double-hook thread engaging heads 31 of the thread catching elements 30 of any one row into the immediately adjacent row results in a closed or continuous thread catch or catching surface of such, in this case double-hook thread engaging heads 31 of the thread catching elements 30. Since double-hooks are here involved as the thread engaging heads 31, these double-hooks extend to opposite sides of the associated pin-like projection or stem 5 of each thread catching element 30. Again, the thread will pass in a serpentine or undulated path of travel between the neighboring or successively arranged rows of thread catching elements 30 and there is provided a relatively large space 17 for the cleaning of the thread remnants or remainders between the neighboring rows of thread catching elements 30.

In all of the herein described constructions, during the thread winding operation the thread support 1 with the slip-on ring 2 rotate at high speed. A thread 11 or the like brought into contact with the catching ribbon or tape 10 is reliably caught by the thread engaging heads 8, 9, 21 or 31 as the case may be, located at the free ends of the pins or stems 5 to first form a lost or expendable thread winding followed by a thread reserve and the thread winding proper.

An adhesive tape has proved to be very suitable for the catching ribbon 10. As an example, the catching ribbon 10 may be stuck onto or adhesively bonded to a slip-on ring 2 preferably made of plastic. However, the catching ribbon 10 may by attached to the slip-on ring 2 in a different way, for example, by fusion.

The catching ribbon 10 may be applied in segments along the whole circumference of the slip-on ring 2 or at the end of the thread support or bobbin 1. However, at least one half of the circumference of the thread support or bobbin 1 should be covered by the segments of the slip-on ring 2. This mainly depends on the winding velocity and the titer of the thread.

Since the positioning of the thread need no longer be very exact, as is the case with known devices, the width of the catching ribbon 10 may be limited to 13 mm, for example, and preferably may lie between 2 and 20 mm.

It is useful to apply the catching ribbon or tape 10 such that the tops of the heads 8, 9, 21 or 31, as the case may be, and the circumference of the slip-on ring 2 lie substantially in one plane.

Finally, the catching ribbon or tape 10 may be formed such that the catching elements 3*a*, 3', 20 or 30 form an integral part or the related catching ribbon 10.

The pins or stems 5 and the thread engaging heads 8, 9, 21 and 31 of the thread catching elements 3*a*, 3', 20 and 30, respectively, are preferably made of plastic and are elastic. However, other materials may be used.

The thread engaging heads 8, 9, 21 and 31 of the pins or pin-like protrusions or stems 5 have outer surfaces which are substantially in line with the outer circumference of the slip-on ring or attachment 2.

The particular advantage of the present invention is the economic manufacture of the attachment or slip-on ring 2, the reliable catching and retention of the thread, which to a large extent is dependent on the kind of thread and its titer, as well as the easy cleaning of thread remnants or remainders and thus allowing the slip-on rings 2 to be used repeatedly.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A catching ribbon structure for catching and holding a thread on a thread support means rotating at high speed, comprising:

a catching ribbon capable of being attached to the thread support means;

said catching ribbon being provided with catching elements for catching and holding the thread;

each of said catching elements possessing a head supported by a pin;

each said head defining a thread engaging portion;

said thread engaging portions of said heads of said catching elements being adjacently arranged to define therebelow respective spaces for receiving threads; and said thread engaging portions of said heads of said catching elements being adjacently arranged in sufficiently close relationship so as to nearly touch each other such that only a single thread can pass between two adjacently arranged thread engaging portions and into the space therebelow without again passing out of said space so that the single thread is reliably retained in said space.

2. The thread catching ribbon structure as defined in claim 1, wherein:

the thread engaging portion of each head defines a double thread-engaging head.

3. The thread catching ribbon structure as defined in claim 2, wherein:

the double thread-engaging head of each two adjacently arranged thread engaging portions define a substantially funnel shaped opening through which there can pass the single thread.

4. The catching ribbon structure as defined in claim 1, wherein:

said catching ribbon comprises an adhesive tape; and said catching elements being attached to said adhesive tape.

5. The catching ribbon structure as defined in claim 1, wherein:

said catching elements extend over a width of between 2 and 20 mm along the catching ribbon.

6. The catching ribbon structure as defined in claim 1, wherein:

each said pin has a free end provided with said head.

7. The catching ribbon structure as defined in claim 6, wherein:

each said head is substantially semi-circular.

8. The catching ribbon structure as defined in claim 6, wherein:

each said head has an anchor-like form.

9. The catching ribbon structure as defined in claim 1, wherein:

said heads of said catching elements have outer surfaces which are substantially in line with one another.

10. The catching ribbon structure as defined in claim 1, further including:

a respective cover ring provided on each side of said catching elements.

11. The catching ribbon structure as defined in claim 1, wherein:

said catching elements are integral with said catching ribbon.

12. The catching ribbon structure as defined in claim 1, wherein:

each said head has a rim bent towards its associated pin to form a barb; and each of said heads and said barb thereof of each said catching element being in the form of a double-hook head.

13. The catching ribbon structure as defined in claim 1, wherein:

the catching elements define elastic thread catching elements.

14. The catching ribbon structure as defined in claim 1, wherein:

the pins of adjacently arranged thread catching elements are spaced from one another in the order of approximately 1 to 4 mm.

15. A catching ribbon structure for catching and holding a thread on a thread support means rotating at high speed, comprising:

a catching ribbon capable of being attached to the thread support means;

said catching ribbon being provided with catching elements for catching and holding the thread;

each of said catching elements possessing a head supported by a pin;

each said head defining a thread engaging portion;

said catching elements being arranged in adjacent rows; and the catching elements of any one adjacent row being arranged in staggered relationship with respect to the catching elements of any immediately adjacent row.

16. The catching ribbon structure as defined in claim 15, wherein:

the projection of the heads of any one row of catching elements into the immediately adjacent row of catching elements defines a continuous thread catching surface.

17. The catching ribbon structure as defined in claim 15, wherein:

the head of each catching element defines a single hook-like thread engaging head.

18. The catching ribbon structure as defined in claim 15, wherein:

the head of each catching element defines a double-hook thread engaging head.

19. The catching ribbon structure as defined in claim 15, wherein:

the catching elements define elastic thread catching elements.

20. A slip-on ring structure for a thread support means, such as a bobbin rotating at high speed, comprising:

a slip-on ring;

a catching ribbon mounted on said slip-on ring;

catching elements carried by said catching ribbon;

each of said catching elements possessing a head supported by a pin;

each said head defining a thread engaging portion;

said thread engaging portions of said heads of said catching elements being adjacently arranged to define therebelow respective spaces for receiving threads; and said thread engaging portions of said heads of said catching elements being adjacently arranged in sufficiently close relationship so as to nearly touch each other such that only a single thread can pass between two adjacently arranged thread engaging portions and into the space therebelow without again passing out of said space so that the single thread is reliably retained in said space.

21. A thread support means for high speed operation for winding a thread thereupon, comprising:

a thread support means;

a slip-on ring mounted on said thread support means;

a catching ribbon carried by said slip-on ring;

catching elements carried by said catching ribbon;

each of said catching elements possessing a head supported by a pin;

each said head defining a thread engaging portion;

said thread engaging portions of said heads of said catching elements being adjacently arranged to define therebelow respective spaces for receiving threads; and said thread engaging portions of said heads of said catching elements being adjacently arranged in sufficiently close relationship so as to nearly touch each other such that only a single thread can pass between two adjacently arranged thread engaging portions and into the space therebelow without again passing out of said space so that the single thread is reliably retained in said space.

* * * * *